US005149011A

United States Patent [19]

Gratt et al.

[11] Patent Number: 5,149,011

[45] Date of Patent: Sep. 22, 1992

[54] RADAR BORESIGHT ERROR COMPENSATOR

[75] Inventors: Harvey J. Gratt, Plano, Tex.; Chris E. Geswender, Clinton, Okla.

[73] Assignee: The United States of America as represented by the Secretary of the Air Force, Washington, D.C.

[21] Appl. No.: 727,264

[22] Filed: Jun. 20, 1991

[51] Int. Cl.[5] ..... F41G 7/28

[52] U.S. Cl. ..... 224/3.19

[58] Field of Search ..... 244/3.19, 3.15, 3.21; 342/77

[56] References Cited

U.S. PATENT DOCUMENTS

| | | | |
|---|---|---|---|
| 3,128,466 | 4/1964 | Brown et al. | 343/705 |
| 3,316,549 | 4/1967 | Hallendorff | 342/77 |
| 3,821,738 | 6/1974 | Quesinberry et al. | 342/77 |
| 3,940,767 | 2/1976 | Dehano et al. | 343/16 R |
| 4,303,211 | 12/1981 | Dooley et al. | 244/3.19 |

*Primary Examiner*—Charles T. Jordan

*Attorney, Agent, or Firm*—Irwin P. Garfinkle; Donald J. Singer

[57] ABSTRACT

A system for correcting the distortion of the plane waves passing through the radome covering an antenna on a missile airframe by nutating the airframe, in both pitch and yaw to quantify the error in accordance with the nutation, and then determining the radome boresight error, and then correcting it in accordance with the solution of certain algorithms.

4 Claims, 2 Drawing Sheets

RADAR BORESIGHT ERROR COMPENSATOR

STATEMENT OF GOVERNMENT INTEREST

The invention described herein may be manufactured and used by or for the Government for governmental purposes without the payment of any royalty thereon.

BACKGROUND OF THE INVENTION

This invention relates to radar-controlled guidance systems for missiles and more particularly to a system which electronically compensates such a guidance system for the effects of directional errors suffered by the microwave guidance signal in traversing a radome which covers the receiving antenna.

When an antenna is enclosed in a radome, the apparent line of sight, generally does not coincide with the true line of sight. The angle between the apparent and the true lines of sight is called the radome-error angle or boresight error rate BER. The radome-error, as defined above, is not a characteristic of the radome alone, but rather depends upon the complex electromagnetic interactions of the complete housing system including the radome and the antenna.

One of the more serious problems encountered in radar-controlled guidance systems, having a radome-covered antenna, has been the development of a satisfactory radome. Apart from certain strength and temperature requirements, the radome design is largely a compromise between aerodynamic and electromagnetic performance. A long, slender, pointed radome is optimum aerodynamically, but cannot readily be made to have good electromagnetic performance, that is, it has a relatively large radome-error. With a blunt radome, acceptable electromagnetic performance can be more readily achieved, but the high drag due to a blunt radome seriously reduces the aerodynamic performance of the missile.

This invention contemplates the introduction of an electronic compensating voltage into the radar-controlled guidance system at a suitable point to reduce or to eliminate the effects produced by radome-errors, which, in the absence of such compensation, would produce a serious guidance defect in the system.

Electrical distortion of plane waves passing through the dielectric material of missile or aircraft radomes results in non-linear and varying boresight errors. The sign of the distortion has stability ramifications for missile guidance. This boresight error rate (BER) must be compensated in order to provide improved system performance.

Positive boresight error rates will result in an increase system gain, driving the system into a limit cycle at the missile body natural frequency. Negative boresight error rates will result in a low frequency phugoid motion which will perturb the intercept. Depending on the intercept scenario and the magnitude of the boresight error rate, the missile system effectiveness can be greatly reduced.

If the sign and magnitude of the boresight error can be determined and compensated, the missile system will remain effective. This invention is a robust filter technique to both learn the boresight error slopes and to compensate for them in generating missile guidance signals.

In the past several solutions to measure and correct boresight error have been attempted. These solutions have involved:

1. Minimization of boresight error by tuning radome materials and construction to the system's operating frequency. While such systems are theoretically very good, in practice, many factors work against this technique. For example, in flight, temperature variations and radome ablation may detune the system, and the system is therefore constrained to operate in a very narrow frequency band.

2. Correction of boresight error has been attempted by factory measurement of the error, and the use of compensation tables to provide the correction. This factory compensation method is very popular, but it suffers most of the limitation of the tuning method. Additionally, if a wider operating frequency is desired, factory testing time (and therefore costs) rise quickly, as does the compensation memory. Additionally, factory compensation is performed when the missile radome is not operating in the pressure and temperature regimes which are authentic for the flight of the missile.

3. Another method used to correct the boresight error problem is biasing the system to positive sign errors to provide protection against phugoid behavior. This method introduces a positive bias into the system to bias away from the negative behavior (phugoid) in favor of the positive behavior (limit cycle at natural frequency). Missile system are more tolerant of positive boresight error than negative error since the limit cycle frequencies are usually high enough to prevent trajectory disturbances. However, this method fails when the scenario is sensitive to any mismatch to boresight error as it does not compensate for the error, but simply biases away from the more sensitive signal. In addition, the radome is still required to have minimal boresight errors as the bias itself will be destabilizing above certain boresight error rate values.

4. Another method involves the running of a bank of Kalman filters with different assumed boresight error rate values and attempting to match observed line of sight behaviors to estimated line of sight behaviors given the BER corruptions. This method required a number of filters and therefore considerable computer memory and throughput requirements. This method cannot explicitly distinguish in-plane from cross-plane error combinations which would make different filters have similar outputs, allowing for incorrect compensations to be selected.

5. Still another prior art method involved driving the system bias to high frequency oscillations and observing the induced target line of sight rate under body motion. This method is similar to prior method 3, above, but continues to positive bias the system to a preset value or until the system displays the positive BER instability ("limit cycling at the body natural frequency"). Driving the positive BER instability limit cycle, the system estimates the effective BER and corrects the compensation. The weakness of this method is that the instability is not designed to make the BER observable and the method does not easily distinguish in-plane and cross-plane compensation, again resulting in incorrect compensation.

PRIOR ART

A search of the prior art yielded a number of U.S. patents. The U.S. Pat. No. 3,128,466 to Brown teaches a method of correcting boresight error in which a plug having a low dielectric constant is inserted in circumferential contact with the front portion of the radome. U.S. Pat. No. 3,940,767 to DeLano teaches a radome error compensation system in which a negative replica of the radome error is generated and added to the directional signal. U.S. Pat. No. 4,303,211 to Dooley corrects the radome error by storing data in digital store of the error over a range of angles and corrects the error by adding the generated signal to the direction error. None of these patents teaches the concept of introducing a driving voltage into the radar-controlled guidance system to determine and then compensate them for the radome error.

SUMMARY OF THE INVENTION

This invention provides a correction for the distortion of the plane waves passing through the radome for an antenna on a missile by nutating the airframe, and then determining the radome boresight error, and correcting it in accordance with the solution of certain algorithms.

BRIEF DESCRIPTION OF THE DRAWINGS

For a clearer understanding of the nature of the invention, reference should now be made to the following detailed specification and to the accompanying drawings in which.

DESCRIPTION OF THE PREFERRED EMBODIMENT

Figure 1:
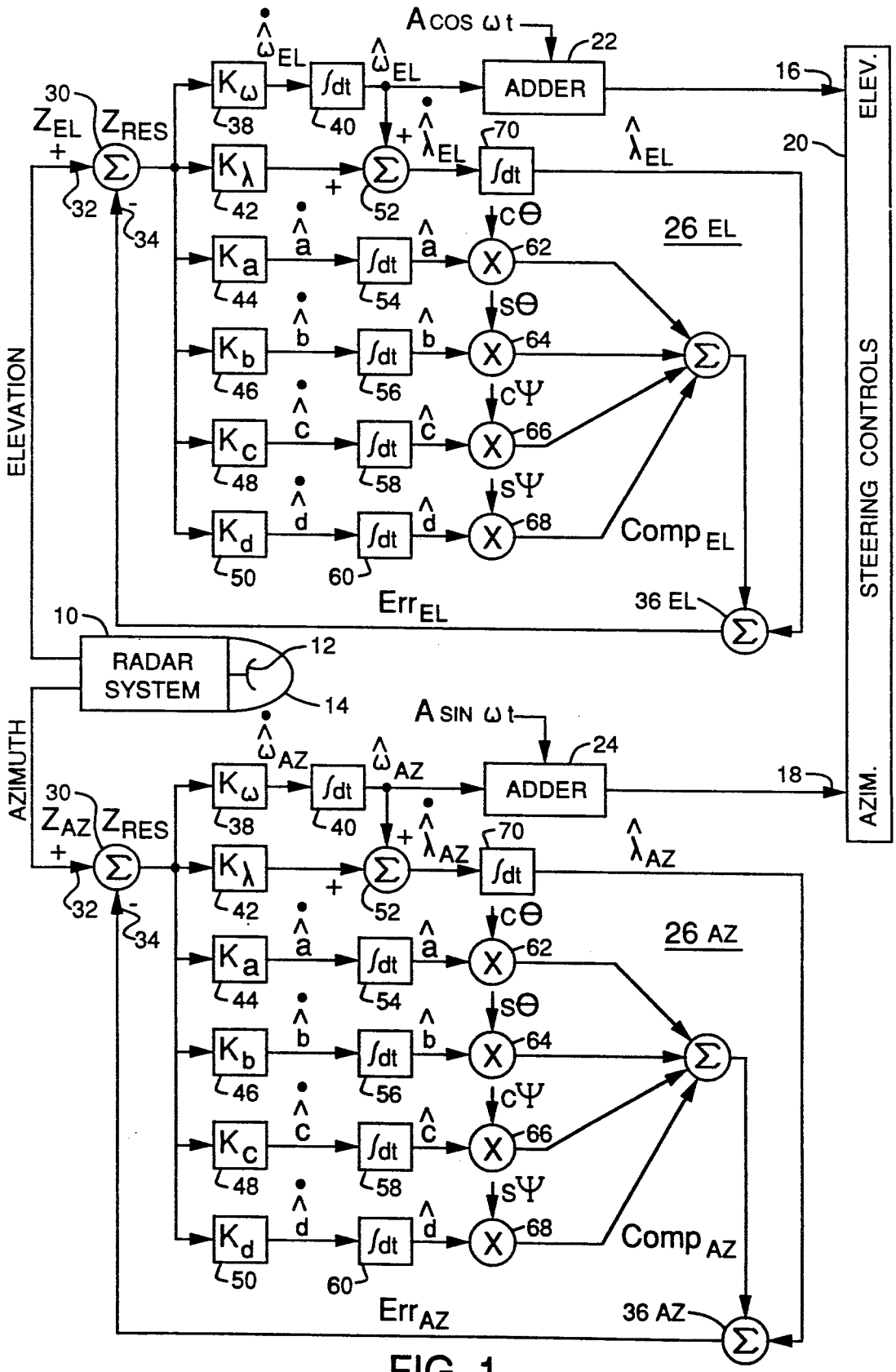
FIG. 1 is a block diagram of a preferred embodiment of the invention.

Referring to FIG. 1, there is shown a radar system 10 having an antenna 12 covered by a conventional radome 14. The elevation and azimuths outputs from the radar system 10 are applied (ultimately) to elevation and azimuth inputs 16 and 18 of the steering control 20 of the airframe (not shown) on which the radar is mounted. The purpose of the system is to lock onto a target (not shown) and steer the missile to it.

As previously noted, the return signals from a target must pass through the radome 14. The nature of the return waves passing through the radome is such that there is a difference between the true line of sight and the apparent line of sight, thereby producing azimuth and elevation signals which would not necessarily steer the vehicle to the target. It is this induced boresight error, i.e., the difference between the true line of sight and the apparent line of sight which this invention seeks to correct.

In order to detect and compensate for boresight error rate, the vehicle is nutated by adding to the elevation and azimuth command signals, pitch and yaw signals, ($Y_p$, $Y_y$) as follows:

| | |
|---|---|
| $\dot{Y}_p = A \cos \omega t$ | A~turn rate amplitude |
| $\dot{Y}_y = A \sin \omega t$ | $\omega$~nutation frequency |

The use of both cos $\omega t$ and sin $\omega t$ is required to effect in-plane and out-plane slope estimates.

As shown in FIG. 1, nutation is accomplished by modulating the elevation and azimuth control signals applied to the terminals 16 and 18 with signals A(cos $\omega t$) and A(sin $\omega t$). Since the vehicle is nutating in accordance with the $Y_p$ and $Y_y$ signals, the output from the radar system 10 has this nutation superimposed on it in both pitch and yaw.

The algorithm required to determine the true line of sight angle is:

where (for elevation channel):

$$\lambda = \omega + K_\lambda[Res]$$

$$Res = [Z - \lambda - \hat{a}\ c\theta - b\ s\theta - c\ c\psi - d\ s\psi]$$

$\omega = K_\omega * Res$ $a = K_a * Res$ $b = K_b * Res$ $c = K_c * Res$ $d = K_d * Res$ $K_\omega$~constant 1

$K_\lambda$~constant 2

$K_a = -K1 * \text{sign}(\theta) \sin \theta$ $K_b = K1 * \text{sign}(\theta) \cos \theta$ $K_c = -K1 * \text{sign}(\psi) \sin \psi$ $K_d = K1\ \text{sign}(\psi) \cos \psi$ K1~learning gain $\theta, \theta, \psi, \psi$~body rates∂angles Z~measured LOS (line-of-sight) angle $\lambda$~estimated LOS angle $\omega$~estimated LOS rate $\hat{a}$,b,c,d parameter estimates related to slope estimates $\omega_G = \omega/(1-b)$~output los rate corrected for radome slope to be used as command In accordance with this invention, there are provided two identical filters $26_{EL}$ and $26_{AZ}$. Since the filters are identical, and for the purpose of simplicity and clarity, the same reference characters will be used to describe the identical elements of the two filters. The outputs $Z_{EL}$ and $Z_{AZ}$ from the radar system 10 are applied, respectively, to the adders 30 at input terminals 32. Also applied to the adders 30 at input terminals 34 are the error outputs $Err_{EL}$ and $Err_{AZ}$ from the outputs of adders 36 of the respective filters $26_{EL}$ or $26_{AZ}$. The elevation and azimuth signals for the steering controls 20 are applied through K$\omega$ multipliers 38, then integrated in the integrator 40 before application to the respective adders 22 and 24.

The output from each of the adders 32 is also applied to each of the multipliers 42, 44, 46, 48 and 50, where the inputs are multiplied by the gains K$\lambda$, Ka, Kb, Kc, and Kd. The output from the multipliers 42 is added in an adder 52 to the $\omega$ outputs of the integrators 40, and then integrated in respective integrators 70. The output of integrators 70 is then applied to an input terminal of the error adders $36_{AZ}$ and $36_{EL}$, respectively.

The output of multipliers 44, 46, 48 and 50 are integrated, respectively in integrators 54, 57, 58 and 60. The output of integrators 54, 56, 58 and 60 are then multiplied in multipliers 62, 64, 66 and 68, respectively. The output of integrator 54 is multiplied by cosine of inplane motion; the output of integrator 56 is multiplied by sine inplane motion. The output of integrator 58 is multiplied by cosine crossplane motion, the output of integrator 60 is multiplied by sine crossplane motion. The outputs of the multipliers 62 and 68 are combined in adder 72 are then added in the respective adders $36_{EL}$ and $36_{AZ}$ before application to the adders 32.

All of the foregoing computations are accomplished with the following computer program:

```
CINPUTS
C       TIME, ANT_TIME, ALOSA, ALOSE, RGIMAN, RGIMEN, GYRO13, GYRO24, FRAME
COUTPUTS
C       ALOSRAZ1, ALOSREL1
CCODE
      KL = 0.35                    ! FILTER CONSTANT 1
      KW = 1.6                     ! FILTER CONSTANT 2
      kkaa = 2.0                   ! LEARNING GAIN
      kkab = KKAA                  !
      FRAME1 = FRAME               ! UPDATE TIME INTERVAL
C
C-------- USE GIMBAL HEAD RATES ----------
          FRGME = RGIMEN
          FRGMA = RGIMAN
          SUMY = SUMY + (FRGMA + FRGMAL)*FRAME1/2.0
          SUMZ = SUMZ + (FRGME + FRGMEL)*FRAME1/2.0
C
C-------- USE BODY RATES ----------
          FGY13 = GYRO13
          FGY24 = GYR024
          SUMDPIT = SUMDPIT + (FGY24 + FGY24L)*FRAME1/2.0
          SUMDYAW = SUMDYAW + (FGY13 + FGY13l)*FRAME1/2.0
C
C-----GENERATE ESTIMATED INERTIAL LINE OF SIGHT
          HLOSEL = ALOSE + SUMzL
          HLOSAZ = ALOSA + SUMyL
          IF     (ILOS.EQ.0.0) THEN
                 HLOSELHAT = HLOSEL
                 HLOSAZHAT = HLOSAZ
                 HLOSELHAT2 = HLOSEL
                 HLOSAZHAT2 = HLOSAZ
                 ILOS = 1
          ENDIF
C
C------ OBSERVABILITY VARIABLES
              TCP = COSS(SUMDPITL)
              TSP = SINN(SUMDPITL)
              TCY = COSS(SUMDYAWL)
              TSY = SINN(SUMDYAWL)
C--- UPDATE EL CHANNEL RADOME COMPENSATOR RESIDUAL
              REL = HLOSEL - HLOSELHAT2
     *                - AKEL2*TCP - BKEL2*TSP
     1                - CKEL2*TCY - DKEL2*TSY
              KAA = -SIGN(KKAA,HGYRO24L)*TSP
              KAB = SIGN(KKAB,HGYRO24L)*TCP
              KAC = -SIGN(KKAA,HGYRO13L)*TSY
              KAD = SIGN(KKAB,HGYRO13L)*TCY
C
C----- EL CHANNEL FILTERS
              HLOSREL1 = HLOSREL2 + KW * REL
              HLOSELHAT = HLOSELHAT2 + KL * REL
C
C----- INTEGRATE EL CHANNEL BER ESTIMATES
              AKEL = AKEL2 + KAA * REL
              BKEL = BKEL2 + KAB * REL
              CKEL = CKEL2 + KAC * REL
              DKEL = DKEL2 + KAD * REL
C
C--- UPDATE AZ CHANNEL RADOME COMPENSATOR RESIDUAL
              RAZ = HLOSAZ - HLOSAZHAT2
     *                - AKAZ2*TCY - BKAZ2*TSY
     1                - CKAZ2*TCP - DKAZ2*TSP
              KAA = -SIGN(KKAA,HGYRO13L)*TSY
              KAB = SIGN(KKAB,HGYRO13L)*TCY
              KAC = -SIGN(KKAA,HGYRO24L)*TSP
              KAD = SIGN(KKAB,HGYRO24L)*TCP
C
C----- AZ CHANNEL FILTERS
              HLOSRAZ1 = HLOSRAZ2 + KW * RAZ
              HLOSAZHAT = HLOSAZHAT2 + KL * RAZ
C
C----- INTEGRATE AZ CHANNEL BER ESTIMATES
              AKAZ = AKAZ2 + KAA * RAZ
              BKAZ = BKAZ2 + KAB * RAZ
              CKAZ = CKAZ2 + KAC * RAZ
              DKAZ = DKAZ2 + KAD * RAZ
C--- EXTRAPOLATE EL CHANNEL ESTIMATES
              HLOSREL2 = HLOSREL1
              HLOSELHAT2 = HLOSELHAT + FRAME * HLOSREL2
              AKEL2 = AKEL
              BKEL2 = BKEL
              CKEL2 = CKEL
```

-continued

```
            DKEL2 = DKEL
C
C--- EXTRAPOLATE AZ CHANNEL ESTIMATES
            HLOSRAZ2 = HLOSRAZ1
            HLOSAZHAT2 = HLOSAZHAT + FRAME * HLOSRAZ2
            AKAZ2 = AKAZ
            BKAZ2 = BKAZ
            CKAZ2 = CKAZ
            DKAZ2 = DKAZ
C
C------ LAGGED STATES FOR NEXT PASS
            HRGIMAL = RGIMAN
            HRGIMEL = RGIMEN
            HGYRO24L = GYRO24
            HGYRO13L = GYRO13
            SUMYL = SUMY
            SUMZL = SUMZ
            SUMDPITL = SUMDPIT
            SUMDYAWL = SUMDYAW
            FGY13L = GRY13
            FGY24L = FGY24
            FRGMAL = FRGMA
            FRGMEL = FRGME
C
C------ RENORMALIZE COMMAND FOR HIGH BER'S
              ALOSREL1 = HLOSREL1/(1.-BKEL2/57.3)
              ALOSRAZ1 = HLOSRAZ1/(1.-BKAZ2/57.3)
              RETURN
              END
```

In summary, this invention provides several important features and novel improvements, as follows:

1) Both in-plane and cross-plane slope estimates are obtained.
2) Minimal computational complexity.
3) Noise robustness.
4) Ability to compensate for high BER's.
5) Continual tracking of changing BER's.
6) Flexibility in choosing filter bandwidth and parameter gains as a function of noise environment.
7) Use of sine and cosine functions to map drift components (DC) of body angles into slow time-varying parameter changes while still maintaining a precise analytic relation to the slope estimates.

Nutation may degrade missile flyout range performance relative to an uncompensated system. However, the uncompensated system may not meet performance requirements. Furthermore, a compensated system may allow a lower drag radome, high yields and/or cheaper radome manufacturing costs. The lower drag radome may more than offset the nutation induced drag (at a given performance level).

Experiments were conducted to demonstrate three primary objectives, which were:

1) To prove that the compensator correctly learns the radome Boresight Error Rates (BER), both in-plane and cross-plane.
2) The compensation technique results in improving scenarios which would have failed due to uncompensated BER.
3) The compensation technique will not negatively impact those scenarios not sensitive to uncompensated BER.

Figure 2:
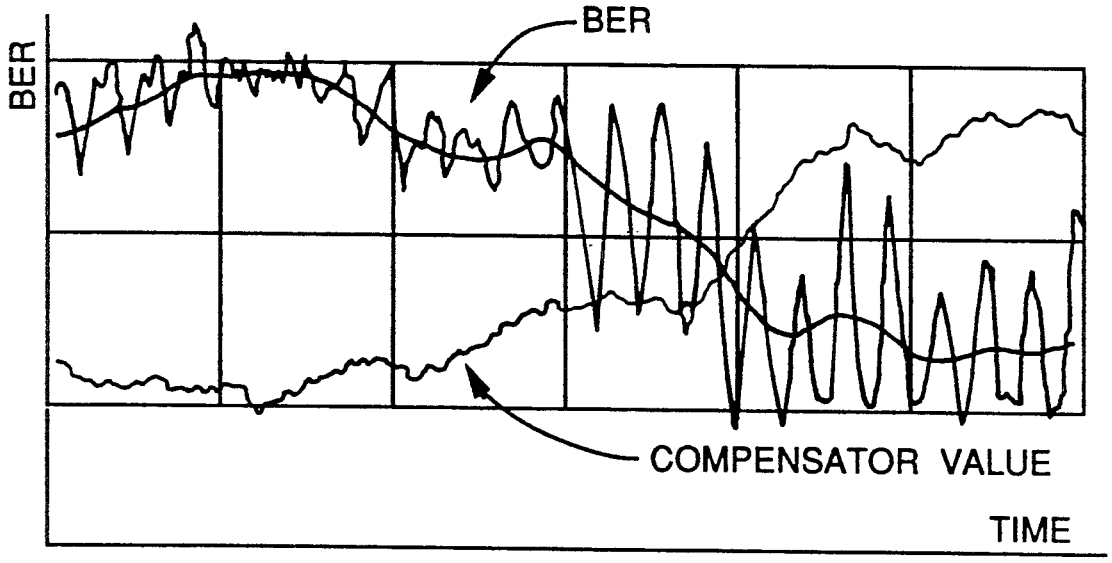
FIG. 2 is curve showing the performance of the system illustrated in FIG. 1.

FIG. 2 shows the learning behavour of the filter when exposed to the conditions of the experiments.

It will be understood by persons skilled in the art that this invention will be subject to various modifications and adaptations. It is intended therefore, that the scope of the invention be limited only by the appended claims as interpreted in the light of the prior art.

What is claimed is:

1. In a vehicle guidance system having a radar controlled steering means for guiding a vehicle to a target, said steering control means having azimuth and elevation control output signals for controlling the steering of said vehicle, the antenna for said radar being enclosed in a radome, a boresight error rate correction system for said radome, said boresight error rate correction system comprising:

means for nutating said vehicle;

said antenna receiving return signals from said target through said radome;

means for processing return azimuth and elevation signals received from said target to determine the true line of sight between said target and said antenna.

2. The combination as defined in claim 1 wherein said means for nutating said vehicle comprises:

means for modulating said azimuth control signal with signals proportional to A sin $\omega t$; and means for modulating said elevation control signal with a signals proportional to A cos $\omega t$;

wherein A~turn rate amplitude; and $\omega$~nutation frequency.

3. The combination as defined in claim 2 wherein said return signal is processed by solving the equation:

$$\lambda=\omega+K\lambda\ (Res)$$

for both azimuth and elevation;

and means for applying the resultant solution to said modulator means for cancelling the nutation signal, and for correcting the line of sight error, and wherein where:

$$\lambda=\omega+K_\lambda[Res]$$

$$Res=[Z-\lambda-\hat{a}\ c\theta-b\ s\theta-c\ c\psi-d\ s\psi]$$

$$\omega=K_\omega * Res$$

$$a=K_a * Res$$

$$b=K_b * Res$$

$$c=K_c * Res$$

$d = K_d * Res$ $K_\omega \sim$ constant 1

$K_\lambda \sim$ constant 2

$K_a = -K1 * \text{sign}(\theta) \sin \theta$ $K_b = K1 * \text{sign}(\theta) \cos \theta$ $K_c = -K1 * \text{sign}(\psi) \sin \psi$ $K_d = K1 \text{ sign}(\psi) \cos \psi$

K1 ~ learning gain $\theta, \theta, \psi, \psi \sim$ body rates∂angles

Z ~ measured LOS (line-of-sight) angle $\lambda \sim$ estimated LOS angle $\omega \sim$ estimated LOS rate â,b,c,d parameter estimates related to slope estimates $\omega_G = \omega/(1-b) \sim$ output los rate corrected for radome slope to be used as command.

4. The combination as defined in claim 3 wherein said processing means includes: a plurality of parallel filters, each of said filters being a function of one of said gains Kω, Kλ, Ka, Kb, Kc, and Kd, and wherein the outputs from each of said filters is applied to said azimuth and elevation controls to correct the line of sight error in both azimuth and elevation.

* * * * *